United States Patent [19]

Weiss

[11] 4,365,141

[45] Dec. 21, 1982

[54] HAIR DRYER

[75] Inventor: Richard V. Weiss, Dallas, Tex.

[73] Assignee: Jerdon Industries, Inc., Richardson, Tex.

[21] Appl. No.: 222,555

[22] Filed: Jan. 5, 1981

[51] Int. Cl.[3] ..... A45D 20/10

[52] U.S. Cl. ..... 219/370; D28/13; 34/96; 200/52 R; 200/61.62

[58] Field of Search ..... 219/369, 370; 42/58, 42/66; 34/96–101; D28/12, 13; 200/157, 52 R, 50 R, 62

[56] References Cited

U.S. PATENT DOCUMENTS

| | | | |
|---|---|---|---|
| 1,436,715 | 11/1922 | Jackson | 42/58 |
| 2,723,491 | 11/1955 | Hersey | 42/58 |
| 3,219,023 | 11/1965 | Ryan | 42/58 |
| 3,766,352 | 10/1973 | Bigley et al. | 200/157 X |
| 3,889,693 | 6/1975 | Tanaka et al. | D28/13 X |

FOREIGN PATENT DOCUMENTS

| | | | |
|---|---|---|---|
| 1164841 | 1/1957 | France | 219/370 |
| 924118 | 4/1963 | United Kingdom | 219/370 |

*Primary Examiner*—Roy N. Envall, Jr.
*Attorney, Agent, or Firm*—H. Mathews Garland

[57] ABSTRACT

An electric hair dryer shaped to appear as a western style gun or six-shooter, wherein the heated air exits from the barrel of the hair dryer gun. The hair dryer gun has a hammer and trigger operated electric switch and safety mechanism designed such that the trigger must be pulled to unlatch the hammer which is connected to the switch. Movement of the hammer serves to turn the hair dryer on and to different modes of operation.

10 Claims, 11 Drawing Figures

HAIR DRYER

This invention relates to a hair dryer and more particularly relates to a six-shooter shaped hair dryer having a hammer and trigger operated electrical switch and safety mechanism.

Electric motor driven portable blower type hair dryers have been manufactured in a number of different shapes. Some dryers have been made with the very general configuration of a hand gun using a cylindrical motor and blower chamber mounted on a handle bearing essentially no resemblance to realistic existing hand guns. Insofar as is presently known no portable hair dryers have been constructed in the form of a realistic hand gun particularly in the form of a realistic western style six-shooter. The presently existing gun type hair dryers utilize switches and related apparatus which is not required to symbolize a part of a realistic gun because of the lack of realism in the entire structure of the dryer. Thus in constructing a realistic six-shooter shaped portable hair dryer a problem is presented in providing operating controls without affecting the realistic appearance of the dryer.

It is a particularly important object of the invention to provide a new and improved portable electric hair dryer.

It is another object of the invention to provide a portable hair dryer in the form of a western style six-shooter.

It is another object of the invention to provide a six-shooter shaped portable hair dryer in which the operating controls comprise the trigger and hammer of the six-shooter.

It is another object of the invention to provide a six-shooter shaped portable hair dryer in which the trigger and hammer are structurally interrelated providing an on-off switch, speed control, and safety mechanism.

In accordance with the invention there is provided a portable electric blower type hair dryer having the shape of a western style-six-shooter including and enlarged barrel housing, an electrical resistance heater, a cylinder section housing an electric motor and blower, a handle housing a slide type electric switch, and a hammer and trigger assembly for operating the slide switch to provide speed control and on-off functions including a safety feature requiring pulling the trigger to move the hammer controlled speed and on-off switch.

The invention and the foregoing objects and advantages thereof will be better understood from the following detailed description of a hair dryer embodying the features of the invention taken in conjunction with the accompanying drawings wherein.

Figure 6:
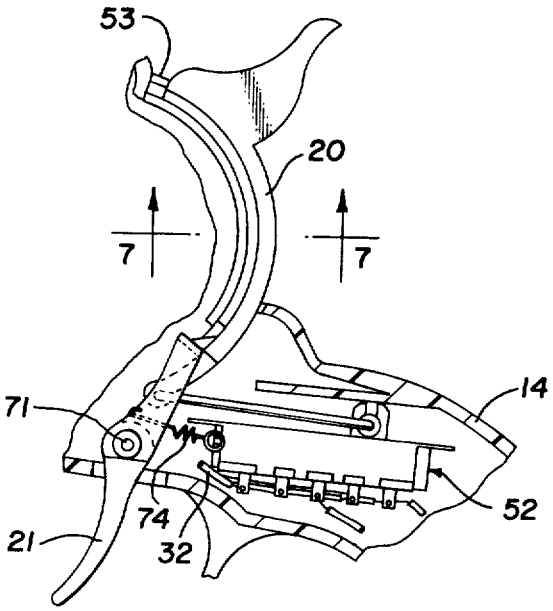
Figure 7:
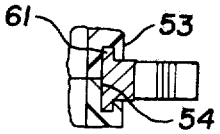
Figure 9:
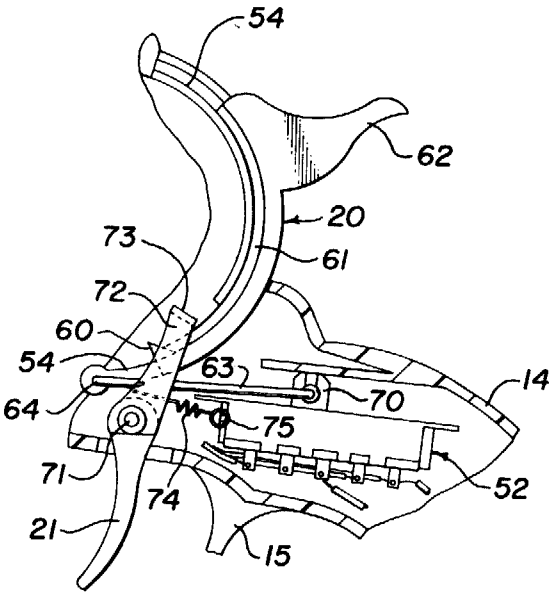
Figure 8:
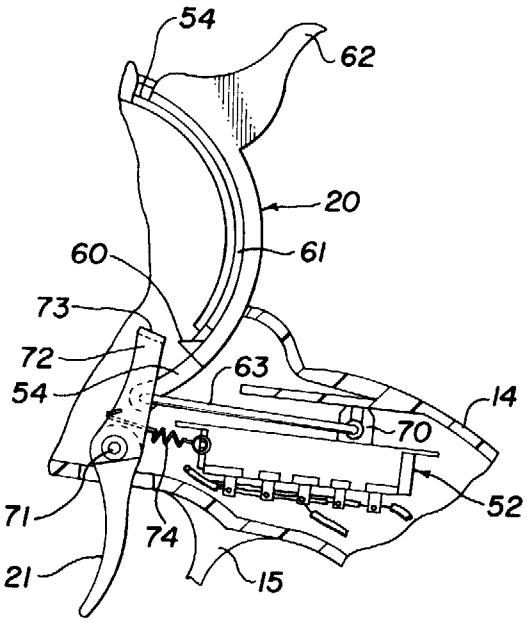
Figure 10:
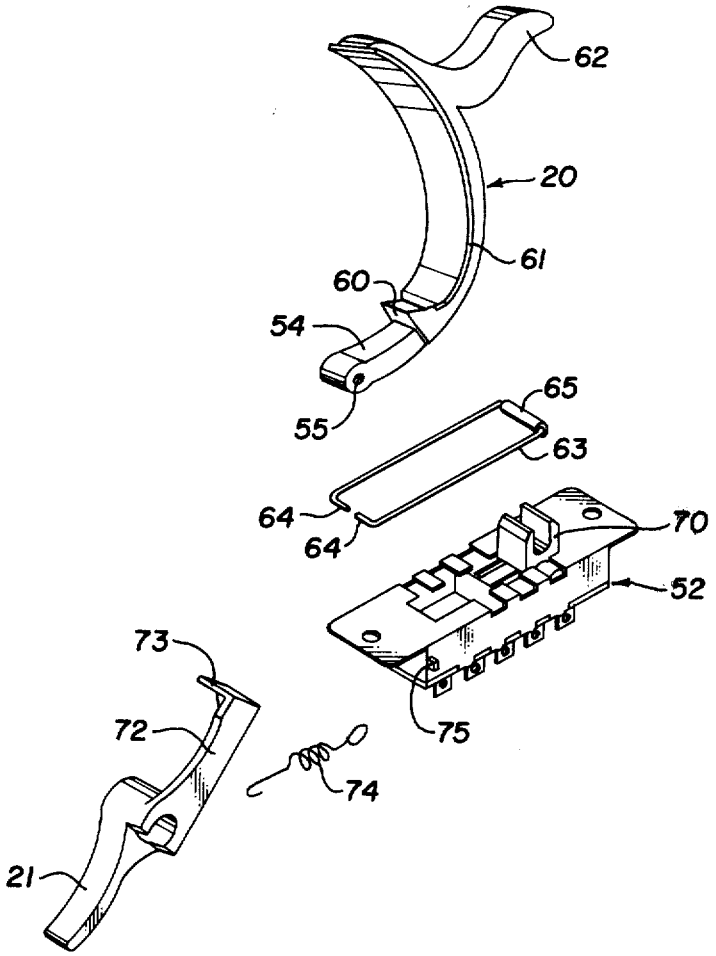

FIGS. 2A, 3, 4, and 5 are enlarged fragmentary views in elevation showing the upper portion of the hammer and the control indicator behind the hammer illustrating the hammer at positions ranging from "off" to the highest dryer operating speed;

FIG. 6 is an enlarged fragmentary side view in section showing the hammer and trigger control assembly coupled with the electrical slide switch used to operate the blower motor;

FIG. 7 is a fragmentary view in section along the line 7–7 of FIG. 6;

FIG. 8 is a fragmentary view in section of the mechanism shown in FIG. 6 illustrating the trigger depressed to a release position for turning the hair dryer "on";

FIG. 9 is a fragmentary view in section of the hammer and trigger mechanism after release of the hammer by the trigger as the hammer is moved to one of the several operating speeds of the dryer; and FIG. 10 is an exploded view of the hammer and trigger control assembly coupled with the electrical slide switch.

Figure 1:
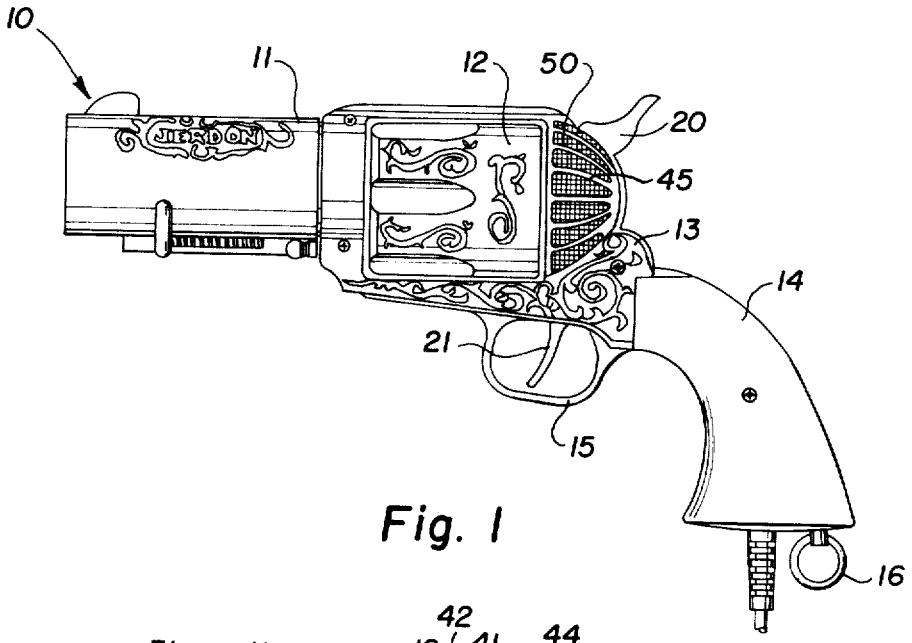
FIG. 1 is a side view in elevation of a hair dryer constructed in accordance with the invention.
Figure 2:
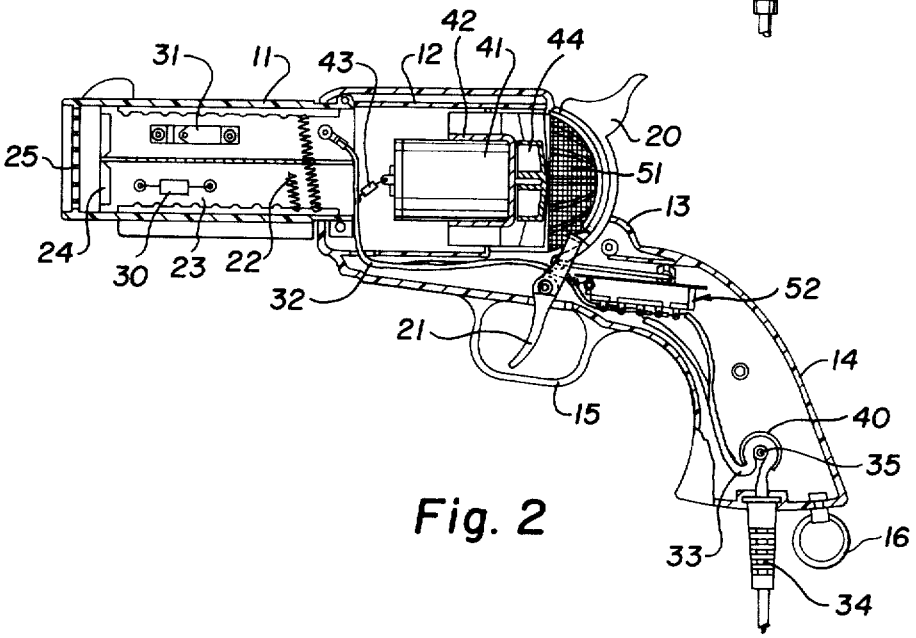
FIG. 2 is a side view in section showing the hair dryer of FIG. 1 with a left hand portion of the barrel, cylinder section, trigger assembly section, and the handle removed to expose the operating structure of the dryer.

Referring to FIGS. 1 and 2 of the drawings, a hair dryer 10 embodying the features of the invention has a case formed of a suitable plastic such as polycarbonate in the shape of a western style six-shooter having a barrel 11, a cylinder section 12, a trigger assembly housing 13, and a handle 14. A trigger guard 15 is secured along the bottom edge of the trigger housing. The six-shooter shaped dryer also includes a hammer 20 which serves as an on-off switch and a speed control and a trigger 21 which functions with the hammer to provide a safety preventing accidentally turning the dryer on. The trigger and the hammer are interconnected by the coupling arrangement which requires that the trigger be depressed to release the hammer from movement to one of several "on" positions for adjusting the speed of operation of the dryer.

While the outer appearance of the dryer is illustrated in FIG. 1, FIG. 2 shows the operating components of the dryer. A spiral-shaped electrical resistence heater 22 is mounted within the barrel on a heater frame 23 held by a metal cross clip 24. A screen-like grill 25 is mounted in the open end of the barrel to permit discharge of heated air from the barrel while preventing the operator's finger or inflammable foreign matter from getting into the barrel in contact with the heating element. A thermal cut-off switch 30 is secured to the heater frame and connected with the heater to prevent overheating. A typical cut-off switch which may be used is manufactured by Micro Device, Inc., catalog number 44184A, rated at 250 volts, 10 amps, with an opening or cut-off temperature of 214° C. A thermostat 31 is mounted on the heater frame connected with the heating element. The thermostat may be a type UD3, manufactured by Uchiya Thermostat Supply, rated at 250 vac, at 10 amps, having an opening temperature of 105° C.±10° C. The heating element wire 22 may be iron chromium heating wire, class 2 SWG No. 27, manufactured by Silver Kobki Company, Ltd. The heater coil is supplied with power through a suitable insulated wires 32 extending from the barrel through the revolver and trigger housing sections into the handle connected with a power supply cord 33 extending from the handle through a bushing 34 secured in the butt end of the handle. Within the handle the power cord is wrapped partially around a pin 35 within a partial circular clip 40 to restrain the cord from pulling from the handle. An electric motor 41 is mounted within a motor housing 42 secured within the cylinder portion 12 of the dryer housing. The motor 41 may be a 24 volt dc motor manufactured by Wah Ming Electric Company, Model HR-355. The motor is connected with the wire 32 through a epoxy-molded silicon junction diode 43 rated at 200

VAC, 1 amp, manufactured by Rectron, Type IN4003. A nylon fan 44 is mounted on the shaft of the motor for blowing air from the cylinder through the housing along the heater element exiting from the open end of the barrel through the grill 25. The air intake for the fan is provided through a semi-spherical back end portion of 45 of the housing cylinder portion 12. The semi-spherical portion 45 is formed by spaced ribs 50 in which is mounted screen 51 which allows the air to flow between the ribs to the fan while preventing the dryers operator's finger from becoming entangled in the fan. The heater element and the fan motor are connected to the power cord through a switch 52 mounted in the handle 14. The switch 52 is a four-positioned, two-pole slide switch manufactured by Shinden Company, Model SDS-2411, rated at 125 VAC, 11 amps.

The slide switch 52 which controls the operation of both the fan motor and the heater element is operated by the hammer 20 and trigger 21 coupled together as shown in detail in FIGS. 6–10 inclusive. The semi-spherical back portion 45 of the cylinder section of the dryer housing has a vertical semi-circular solid portion 53, FIG. 7, provided with a T-shape slide recess 54 for slidable mounting of the semi-circular hammer 20 in the back face of the cylinder section of the dryer. The hammer 20 as best seen in FIG. 10 is a semi-circular integral part having a switch-operating foot 54 provided with a transverse hole 55, an internal triangular latch 60, a semi-circular internal flange 61 which is wider than the main body portion of the hammer, and a hammer-operating handle 62. As seen in FIG. 7, the hammer flange which gives the hammer a T-shaped cross section fits within the T-shaped recess 54 formed in the semi-spherical back face 45 of the dryer housing. The recess 54 is sufficiently longer than the hammer flange 61 to permit the hammer to move from a "off" position through three operating speeds as represented in FIGS. 8 and 9 and FIGS. 2A through 5. The hammer foot 54 is secured with a wire slide switch connector 63 having bent end portions 64 fitting in the hole 55 of the hammer foot and a bushing 65 engaged in a slide switch operator 70. Up and down movement of the hammer 20 along the semi-circular path defined by the recess 54 causes the hammer foot to push and pull the slide switch connector 63 moving the slide switch operator 70 back and forth between the various control positions of the slide switch ranging from an "off" position to a maximum heat and blower speed position. The trigger 21 is mounted within the trigger housing on a transverse pin 71 permitting the trigger to pivot on the pin between the hammer release and latch positions as represented in FIGS. 8 and 9. As shown in FIG. 10, the trigger 21 has a latch finger 72 provided with an end positioned latch flange 73. The latch flange 73 extends transversely perpendicular to the latch finger 72 so that when the trigger is at the "safety" or locked position as illustrated in FIG. 6, the latch flange 73 engages the hammer latch 60 locking the hammer in the upper "off" position. A spring 74 is connected between a small lug 75 on the slide switch and the trigger finger 72 biasing the trigger clockwise as seen in FIG. 6 toward the "safety" position.

Figure 2A:
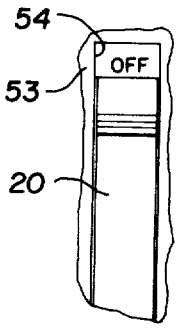
Figure 3:
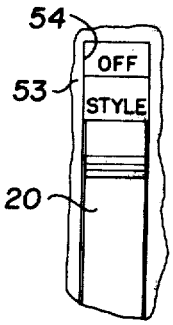
Figure 4:
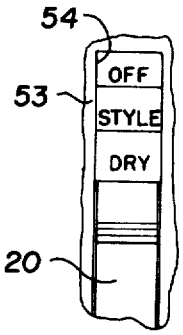
Figure 5:
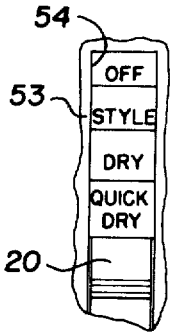

The back face of the dryer housing portion 53 along the bottom or floor of the recess 54 is marked to denote the various operating stages of the dryer as evidenced by the position of the hammer 20 which controls the position of the slide switch 52. At the upper end position of the hammer at which the dryer is not operating, or stated otherwise is "off", as shown in FIG. 2A, the word "off" is visable along the recess floor 54 above the upper end of the hammer 20. As the hammer moves downwardly along the semi-circular recess 54, the dryer is turned on to the first operating condition of the dryer at which the word "style" is uncovered along the floor of the recess 54 as shown in FIG. 3. The next operating speed or condition of the dryer is illustrated in FIG. 4 at which the word "dry" is exposed along the base of the recess 54 by the upper end of the hammer. The last and highest operating speed and heat of the dryer is illustrated by FIG. 5 at which the words "quick dry" are exposed above the upper end of the hammer with the hammer at the lower end position in the recess.

When the dryer is "off" as represented in FIGS. 2A and 6, the hammer 20 is at an upper end position at which the spring 74 biases the trigger 21 in a clockwise direction with the latch finger 72 of the trigger extending along the side of the hammer foot 54 and the trigger latch flange 73 is positioned across and above the hammer foot engaged with the lower face of the hammer latch finger 60 holding the hammer against downward movement. At this position of the hammer as illustrated in FIG. 2A, the marking "off" is visable to the operator of the dryer holding the dryer by the handle 14 in a position at which a pistol is normally held. In these relative positions of the hammer and trigger, the "safety" of the dryer is considered as "on". In this context the "safety" is the combination of the latch 60 on the hammer 20 and the flange 73 on the trigger which cooperate to prevent the hammer from being moved downwardly from the "off" position. To release the hammer for starting or turning the dryer "on" the trigger 21 is depressed by the dryer operator's "trigger finger" pulling the trigger back toward the operator rotating the trigger counter-clockwise from the pin 71, lifting the safety finger 72 and the safety flange 73 in a counter-clockwise arc out of engagement with the latch 60 on the hammer 20 to the position illustrated in FIG. 8. With the trigger flange 73 disengaged from the latch 60 on the hammer, the hammer is drawn downwardly by the thumb of the operator with the hammer moving in the arc defined by the recess 54. As the hammer moves downwardly around the arc in a clockwise direction, the slide switch connector 63 is pulled toward the left as viewed in FIGS. 8 and 9, pulling the slide switch operator 70 toward the left. As soon as the hammer is moved slightly downwardly, the safety latch 60 on the hammer moves below the safety flange 73 of the trigger so that the trigger may be released allowing the spring 74 of the trigger to bias the trigger back clockwise until the lower edge of the safety flange 73 engages the front face of the hammer flange 61 as shown in FIG. 9. At the position of the trigger and trigger safety flange 73 shown in FIG. 9, the hammer is free to move to the three different operating positions represented in FIGS. 3–5. The markings along the bottom of the recess 54 represented in FIGS. 3–5 are easily visable to the dryer operator so that the operator may position the hammer to obtain the desired operating speed and temperature. The first or lowest speed and temperature is designated "style"; the second operating speed and temperature designated "dry" is obtained by moving the hammer slightly forward downwardly; and the highest speed and temperature designated "quick dry" is obtained by moving the hammer to the lowest position represented by FIG. 5. As the hammer moves downwardly, the slide switch operator 70 is sequentially moved toward the left positioning the switch properly for the desired operating condition of the dryer.

When the dryer is again to be cut "off", the dryer operator's "trigger finger" is used to return the hammer by means by handle 62 back upwardly along the arcuate path to the "off" position of FIG. 2A. As the hammer moves upwardly when the top angular face of the latch 60 engages the bottom edge of the trigger latch flange 73, the trigger is cammed slightly counter-clockwise allowing the flange 73 to pass over the hammer latch 60. As soon as the hammer latch is raised slightly above the trigger latch flange, the spring 74 pivots the trigger back clockwise engaging the latch flange with the forward upward face of the hammer foot 54 moving the trigger back to the "safety" position of FIG. 6 at which the hammer cannot be moved from the "off" position without depressing or pulling the trigger.

When the dryer is turned "on" to any one of the several operating positions of the hammer, the slide switch 52 starts the motor 41 turning the fan 44 and energizes the heater element 22. Air is drawn into the cylinder portion 12 through the screen 51 in the back of the cylinder portion and is discharged forwardly into the barrel 11. The air flows along the barrel within the heater element which heats the air. The air is then discharged from the dryer through the grill 25 at the open end of the barrel. The barrel is of course pointed toward the hair of the operator discharging the heated air against the hair.

When the hair dryer is not in use, it may be conveniently hung on a hook by means of the wing 16 in the handle 14.

It will now be seen that a new and improved hair dryer has been described and illustrated and more particularly a new and improved hair dryer in the unique form of a western styled "six-shooter" has been described and illustrated utilizing an operating switch and safety mechanism comprising the hammer and trigger assembly of the dryer.

What is claimed is:

1. A hair dryer in the form of a hand gun comprising: a hand-gun shaped housing having a barrel provided with an open discharge end; an electrical heater in said housing; an electric motor in said housing; a fan connected with said motor to blow air through said barrel along said heater discharging said air from the open end of said barrel; an electrical switch connected with said heater and said motor; an electrical supply cord connected with said switch; a hammer connected with said switch for operating said switch between "off" position and a plurality of different dryer operating conditions; and a trigger operable with said hammer for releasably holding said hammer at a "safety off" position and disengageable from said hammer for releasing said hammer to operate said dryer.

2. A hair dryer in accordance with claim 1 wherein said housing is in the shape of a western style revolver.

3. A hair dryer in accordance with claim 2 wherein said hammer has a safety latch and said trigger has a safety latch locking flange movable between a safety lock position at which said locking flange engages said hammer latch and a release position at which said locking flange is disengaged from said hammer latch freeing said hammer to move.

4. A dryer in accordance with claim 3 wherein said hammer is an arcuate member movable along an arcuate path defined along said housing and said trigger is mounted in said housing to pivot relative to said hammer for moving said locking flange along an arcuate path between lock and release positions relative to said safety latch on said hammer.

5. A dryer in accordance with claim 4 wherein said switch is a slide switch coupled with said hammer.

6. A hair dryer comprising: a housing formed in the shape of a western style revolver having an enlarged barrel provided with an open end for discharge of air; an electrical resistence heater element secured within said barrel for heating air flowing through said barrel to said open end; an electric motor and fan secured within the cylinder portion of said housing for blowing air along said barrel over said heater to said open end of said barrel; said cylinder portion of said housing having a plurality of said openings behind said fan for air intake; an electrical switch secured within said housing connected with said heater and said motor for controlling the operation thereof; a hammer movably secured with said cylinder portion of said housing; a switch connector between said hammer and said switch within said housing for operating said switch with said hammer; a trigger pivotally secured with said housing; and means on said hammer and on said trigger for releasably latching said hammer with said trigger at a first "off" position of said hammer and for releasing said hammer for movement to a plurality of "on" positions.

7. A dryer in accordance with claim 6 wherein a back portion of said cylinder section of said housing is provided with an arcuate recess and said hammer is an arcuate member movably secured in said recess and having an operator foot connected with said switch connector for moving said switch responsive to movement of said hammer in said arcuate recess.

8. A hair dryer in accordance with claim 7 wherein said hammer has a safety latch formed thereon and said trigger has a safety flange on an inward end portion thereof, engageable with said hammer safety for latching said hammer at an "off" position and for disengagement from said hammer safety for release of said hammer to move to said "on" positions.

9. A hair dryer in accordance with claim 8 wherein said switch is a slide-type switch.

10. A hair dryer in accordance with claim 9 wherein the surface of said cylinder portion of said housing defining the bottom of said arcuate recess is provided with a plurality of spaced indicia indicating the "off" position of said hammer and the plurality of "on" positions of said hammer as sequentially uncovered by said hammer as said hammer moves from said "off" position to said "on" positions.

* * * * *